US011834772B2

(12) United States Patent
Jung et al.

(10) Patent No.: US 11,834,772 B2
(45) Date of Patent: Dec. 5, 2023

(54) LAUNDRY TREATING APPARATUS

(71) Applicant: LG Electronics Inc., Seoul (KR)

(72) Inventors: Sungwoon Jung, Seoul (KR); Hyehyun Sim, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 105 days.

(21) Appl. No.: 17/501,427

(22) Filed: Oct. 14, 2021

(65) Prior Publication Data

US 2022/0112649 A1 Apr. 14, 2022

(30) Foreign Application Priority Data

Oct. 14, 2020 (KR) ..... 10-2020-0132484

(51) Int. Cl.

| | |
|---|---|
| ***D06F 39/02*** | (2006.01) |
| ***D06F 23/02*** | (2006.01) |
| ***D06F 37/30*** | (2020.01) |
| ***D06F 39/08*** | (2006.01) |
| ***D06F 39/12*** | (2006.01) |

(52) U.S. Cl.

CPC ..... *D06F 39/028* (2013.01); *D06F 23/025* (2013.01); *D06F 37/30* (2013.01); *D06F 39/088* (2013.01); *D06F 39/12* (2013.01)

(58) Field of Classification Search

None

See application file for complete search history.

(56) References Cited

U.S. PATENT DOCUMENTS

2005/0229645 A1* 10/2005 Kim ..... D06F 39/028 68/17 R
2006/0053842 A1* 3/2006 Je ..... D06F 39/02 68/3 R
2014/0165665 A1* 6/2014 Del Pos ..... D06F 39/007 68/200

FOREIGN PATENT DOCUMENTS

| | | |
|---|---|---|
| EP | 3851568 | 7/2021 |
| KR | 20090089059 | 8/2009 |
| KR | 20100037454 | 4/2010 |

OTHER PUBLICATIONS

Extended European Search Report in European Appln. No. 21202332.9, dated Mar. 1, 2022, 7 pages.

* cited by examiner

*Primary Examiner* — Cristi J Tate-Sims
(74) *Attorney, Agent, or Firm* — Fish & Richardson P.C.

(57) ABSTRACT

A laundry treating apparatus includes a cabinet, a tub, a drum, and a rotation shaft extending in a front-rear direction, and a detergent dispenser configured to be inserted into and withdrawn from the cabinet. The detergent dispenser includes a dispenser tray, a dispenser housing accommodating the dispenser tray, and a dispenser cover seated on the dispenser housing and configured to supply wash water to the dispenser tray or the dispenser housing. The dispenser cover has a front supply flow path configured to supply the wash water to a front portion of the dispenser housing, and the dispenser housing has a front flow path configured to diffuse the wash water supplied from the front supply flow path. The front flow path is defined at a front portion of a bottom surface of the dispenser housing and configured to guide the wash water to a discharge hole defined at the bottom surface.

19 Claims, 11 Drawing Sheets

LAUNDRY TREATING APPARATUS

CROSS-REFERENCE TO RELATED APPLICATION

This application claims the benefit of Korean Patent Application No. 10-2020-0132484, filed on Oct. 14, 2020, which is hereby incorporated by reference as if fully set forth herein.

TECHNICAL FIELD

The present disclosure relates to a laundry treating apparatus, and more particularly, to a laundry treating apparatus having an improved flow path structure of a detergent dispenser.

BACKGROUND

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a cabinet forming an appearance of the laundry treating apparatus, a tub accommodated in the cabinet, a drum that is rotatably mounted inside the tub and into which the laundry is put, and a detergent dispenser that supplies detergent into the drum.

When the drum is rotated by a motor while wash water is supplied to the laundry accommodated in the drum, dirt on the laundry may be removed by friction with the drum and the wash water.

The detergent dispenser has a detergent supply function to enhance a washing effect. In this connection, the detergent refers to a substance that enhances the washing effect, such as fabric detergent, fabric softener, fabric bleach, and the like. Detergent in a powder form and detergent in a liquid form may be used.

In one example, Korean Patent Publication Application KR 10-2018-0090003 A1 discloses a detergent dispenser included in a laundry treating apparatus. The laundry treating apparatus according to the prior art may be used as a dispenser tray of the detergent dispenser is retracted or extended by a user.

The detergent may be stored in the dispenser tray, and the detergent dispenser is constructed to supply the detergent stored in the dispenser tray to the tub along with the wash water. In addition, the detergent dispenser may have various electrical components that use electricity and include circuits or the like, such as a pump for supplying the detergent, for identifying a retracted state of the dispenser tray, or identifying a supply state of the wash water.

In one example, in the case of the detergent dispenser as described above, the detergent in the powder or the liquid state may remain in the detergent dispenser, and the detergent in the powder or the liquid state may adhere to a flow path of the detergent dispenser when used for a long time.

The adhesion of the detergent inside the detergent dispenser may interfere with flow of the wash water or the detergent. In addition, when foreign substances such as lint and dust are mixed and adhered, the user may feel visually displeasure feeling.

Therefore, an improvement of a structure for preventing the powder or liquid detergent from adhering to the interior of the detergent dispenser is an important task in the art.

SUMMARY

The present disclosure has been devised to solve the above problems, and has a purpose of providing a laundry treating apparatus that improves a flow path structure of a detergent dispenser to prevent powder or liquid detergent from adhering to an interior of the detergent dispenser.

In addition, the present disclosure has been devised to solve the above problems, and has a purpose of providing a laundry treating apparatus that improves a flow path structure of a detergent dispenser to prevent adhesion of powder or liquid detergent, thereby allowing wash water and the detergent to flow smoothly inside the detergent dispenser.

In addition, the present disclosure has been devised to solve the above problems, and has a purpose of providing a laundry treating apparatus that improves a flow path structure of a detergent dispenser to prevent adhesion of powder or liquid detergent, thereby preventing a user from feeling visually displeasure feeling.

In one example, the purposes of the present disclosure are not limited to the above-mentioned purposes, and other purposes not mentioned will be clearly understood by those skilled in the art from the following description.

In an aspect of the present disclosure, provided is a laundry treating apparatus including a cabinet having an entrance defined in a front surface thereof, a tub installed inside the cabinet, a drum rotatably installed inside the tub, wherein a front surface of the drum is open to put laundry into the drum, and a rotation shaft extending in a front and rear direction is coupled to a rear surface of the drum, and a detergent dispenser retracted into and extended from the cabinet through the entrance, wherein detergent is stored in and supplied into the detergent dispenser, wherein the detergent dispenser includes a dispenser tray constructed to be retracted into and extended from the cabinet through the entrance, wherein an auxiliary agent such as detergent is temporarily stored inside the dispenser tray, and is discharged together with wash water, a dispenser housing disposed inside the cabinet, and having a bottom surface and side walls for defining a space for accommodating the dispenser tray therein, wherein a discharge hole in communication with the tub is defined in the bottom surface, and a dispenser cover seated on the dispenser housing, wherein the dispenser cover supplies wash water to the dispenser tray or the dispenser housing, wherein the dispenser cover has a front supply flow path defined therein for supplying wash water to a front portion of the dispenser housing, wherein a front flow path for diffusing wash water supplied from the front supply flow path of the dispenser housing on a front portion of the bottom surface of the dispenser housing to be guided to the discharge hole.

In one implementation, the front flow path may include a vertical flow path defined on one side of the side wall to be recessed outwardly of the dispenser housing, and an inclined flow path connected to the vertical flow path, protruding inwardly of the side wall, and inclined downward forwardly of the bottom surface along the side wall.

In one implementation, a plurality of guide ribs for guiding the flow of wash water supplied from the front supply flow path may be further formed on the vertical flow path.

In one implementation, the front supply flow path may include a plurality of water supply holes defined therein for supplying wash water to the vertical flow path, and the front flow path may extend to the inclined flow path between the water supply holes.

In one implementation, an extension rib for outwardly covering the vertical flow path may be further formed below the water supply hole.

In one implementation, a guide partition wall may be further formed in the inclined flow path in a direction parallel to a formation direction of the inclined flow path to prevent deviation of wash water flowing through the vertical flow path.

In one implementation, the vertical flow path may be defined spaced rearwardly apart from the front portion of the dispenser housing, wherein the inclined flow path guides wash water to the front portion of the dispenser housing.

In one implementation, an inclined surface may be formed at the front portion of the bottom surface such that wash water flowing through the inclined flow path flows toward the discharge hole.

In one implementation, the front flow path may include a vertical flow path defined on the side wall to be recessed outwardly of the dispenser housing, a first inclined flow path for guiding a portion of wash water flowing through the vertical flow path toward the front portion of the bottom surface, and a dispersion rib protruding to form a flow path resistance in a direction transverse to a flow direction of wash water flowed by the first inclined flow path.

In one implementation, the first inclined flow path may be defined with a concave curved surface extending from a lower portion of the vertical flow path to the front portion of the bottom surface.

In one implementation, the dispersion rib may include a plurality of ribs forming the flow path resistance of wash water with a predetermined height, and a dispersion groove to be passed by wash water may be defined between adjacent two of the plurality of ribs.

In one implementation, the plurality of ribs may include a first rib having a predetermined height and a second rib having a height smaller than the height of the first rib, and the second rib may be located at an upper portion of the first inclined flow path.

In one implementation, an inclined surface may be formed at the front portion of the bottom surface such that wash water flowing through the first inclined flow path flows toward the discharge hole.

In one implementation, the laundry treating apparatus may further include a second inclined flow path for guiding a portion of wash water flowing through the vertical flow path to a center of the bottom surface.

In one implementation, a guide groove connected to the second inclined flow path, and guiding wash water to the center of the bottom surface may be further defined in the bottom surface.

In one implementation, an inclined surface for guiding wash water flowed by the guide groove toward the discharge hole may be further formed on the bottom surface.

The laundry treating apparatus according to an embodiment of the present disclosure may improve the flow path structure of the detergent dispenser to prevent the powder or liquid detergent from adhering to the interior of the detergent dispenser.

In addition, the laundry treating apparatus according to an embodiment of the present disclosure may improve the flow path structure of the detergent dispenser to prevent the adhesion of the powder or liquid detergent, thereby allowing the wash water and the detergent to flow smoothly inside the detergent dispenser.

In addition, the laundry treating apparatus according to an embodiment of the present disclosure may improve the flow path structure of the detergent dispenser to prevent the adhesion of the powder or liquid detergent, thereby preventing the user from feeling the visually displeasure feeling.

In one example, the effects of the present disclosure are not limited to the above-mentioned effects, and other effects not mentioned will be clearly understood by those skilled in the art from the description of claims.

DETAILED DESCRIPTION

Figure 1:
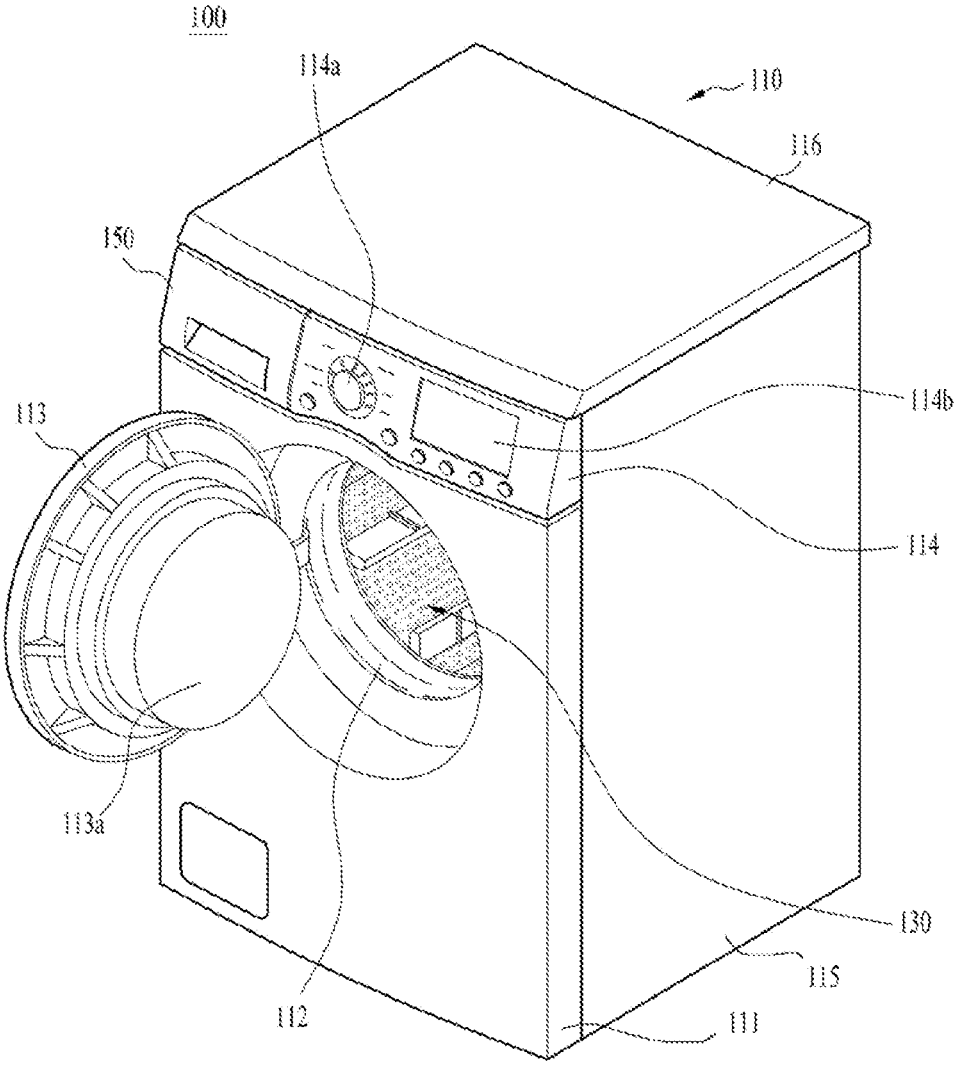
FIG. 1 is a perspective view showing a laundry treating apparatus according to an embodiment of the present disclosure.

Hereinafter, a laundry treating apparatus according to an embodiment of the present disclosure will be described in detail.

In describing the present disclosure, the defined name of each component is defined in consideration of a function thereof in the present disclosure. Therefore, it should not be construed as limiting the technical component of the present disclosure. In addition, each name defined for each component may be referred to as another name in the art.

Therefore, the present disclosure is not limited to the following embodiment, and various modifications and variations are possible from such description by those having ordinary knowledge in the technical field to which the present disclosure belongs. When such modifications include the main components of the present disclosure, it may be seen as being included in the present disclosure.

In addition, regardless of the reference numerals, the same or corresponding components are given the same reference numbers, and duplicate descriptions thereof will be omitted. For convenience of description, the size and the shape of each component shown may be exaggerated or reduced.

In one example, it will be understood that, although the terms "first", "second", "third", and so on may be used herein to describe various components, these components should not be limited by these terms. These terms are used to distinguish one component from another component.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in this specification, the term 'and/or' includes a combination of a plurality of listed items or any of the plurality of listed items. In the present specification, 'A or B' may include 'A', 'B', or 'both A and B'.

First, each component of a laundry treating apparatus according to an embodiment of the present disclosure will be described in detail with reference to the accompanying drawings.

Figure 2:
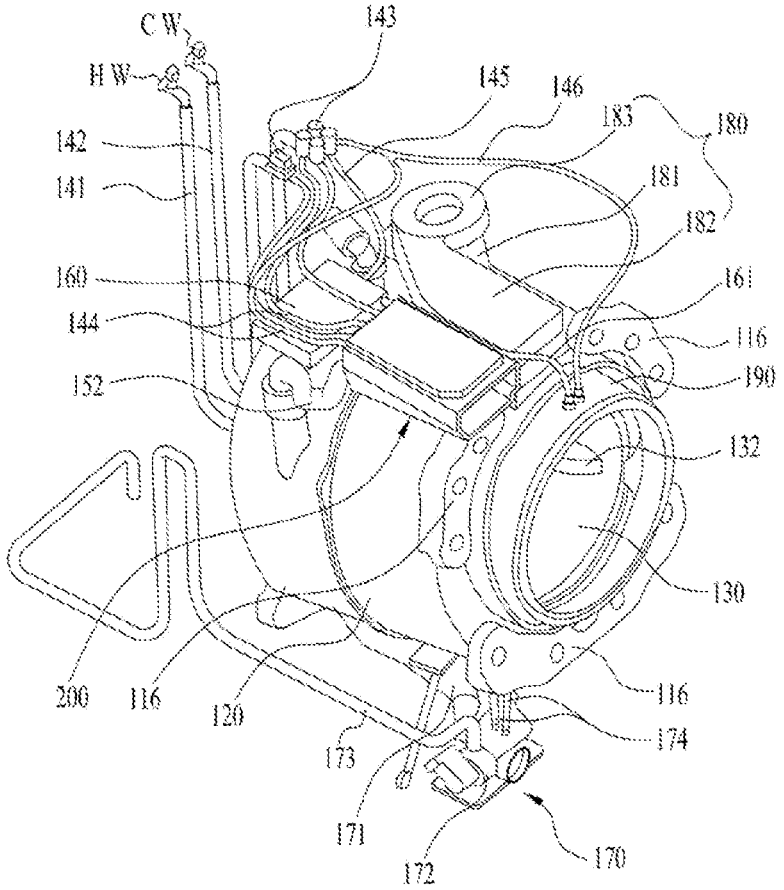
FIG. 2 is a simplified view showing an internal structure of a laundry treating apparatus according to an embodiment of the present disclosure.

FIG. 1 is a perspective view showing a laundry treating apparatus according to an embodiment of the present disclosure, and FIG. 2 is a simplified view showing an internal structure of a laundry treating apparatus according to an embodiment of the present disclosure.

As shown in FIGS. 1 to 2, a laundry treating apparatus 100 according to an embodiment of the present disclosure may include a cabinet 110 that forms an appearance of the laundry treating apparatus 100, a tub 120 disposed inside the cabinet 110 and storing wash water therein, a drum 130 that is rotatably disposed inside the tub 120, a water supplier 140 for supplying the wash water to the tub 120, a detergent dispenser 200 that mixes the water supplied from the water supplier 140 with detergent to form a mixture and supplies the mixture to the tub 120, a steam generator 160 that heats the water supplied from the water supplier 140 to supply steam to the tub 120, a drainage 170 that discharges the wash water after washing, and a dryer 180 that heats air in the tub 120 and supplies/circulates the heated air.

The cabinet 110, which forms the appearance of the laundry treating apparatus 100, may include side surface cabinets 115 forming side surfaces of the laundry treating apparatus 100, a base (not shown) forming a bottom surface of the laundry treating apparatus 100, a front surface cabinet 111 having a laundry inlet 112 defined therein such that laundry may be put into or withdrawn from the laundry treating apparatus 100, and coupled to front surfaces of the side surface cabinets 115, a top surface cabinet 116 disposed on top of the side surface cabinets 115, and a door 113 that is pivotably fastened to the front surface cabinet 111 to open and close the laundry inlet 112.

In one example, a control panel 114 is disposed on an upper portion of the front surface cabinet 111. The control panel 114 may include a course selection unit 114*a* for receiving course selection input from a user, and a display 114*b* for receiving various control commands from the user and displaying an operating state of the laundry treating apparatus 100.

In addition, the door 113 may have a glass 113*a* such that the laundry inside the drum 130 may be observed from the outside of the laundry treating apparatus 100. The glass 113*a* may be formed in a convex shape, and a tip of the glass 113*a* may protrude up to an interior of the drum 130 in a state in which the door 113 is closed.

The tub 120 may be formed in a shape suspended inside the cabinet 110. A motor (not shown) and a rotation shaft (not shown) for rotating the drum 130 may be disposed at the rear of the tub 120. In this connection, the drum 130 may be divided into a direct driving-type drum and an indirect driving-type drum based on a scheme of transferring a driving force provided from the motor to the drum 130.

In this connection, in the direct driving scheme, the rotation shaft of the motor is directly fastened with the drum 130, and the rotation shaft of the motor and a center of the drum 130 are aligned on the same line. In the indirect driving scheme, the drum 130 is rotated using power transmission means such as a belt or a pulley that transmits the driving force provided from the motor, and the rotation shaft of the motor and the center of the drum 130 are not necessarily aligned on the same line.

The laundry treating apparatus 100 according to the present embodiment follows such direct driving scheme, and the drum 130 is rotated by the motor 121 disposed at the rear of the tub 120. However, the present disclosure is not necessarily limited thereto, and the indirect driving scheme to be described later is also applicable.

The tub 120 as described above may be suspended from the cabinet 110 by a spring (not shown), and may further have a damper (not shown) for supporting the tub 120 from below such that vibration generated when the drum 130 rotates may be buffered.

In addition, a heater (not shown) for heating water stored in the tub 120 may be further disposed inside the tub 120. In one example, a weight 116 for increasing a weight of the tub 120 itself to raise a vibration limit of the tub may be disposed on a front surface of the tub 120.

The drum 130 is disposed inside the tub to be rotatable by being connected to the rotation shaft to receive a rotational force of the motor. A plurality of through-holes (not shown) may be defined in an inner circumferential surface of the drum 130 such that the wash water stored in the tub 120 may flow into the drum 130. In addition, one or more lifters 132 may be disposed on an inner surface of the drum 130 along the inner circumferential surface of the drum 130 such that the laundry put into the drum 130 may be moved by the rotation of the drum 130.

In one example, the tub 120 and the drum 130 may be disposed in a horizontal state, but alternatively, may be disposed to have a predetermined inclination such that rear portions of the tub 120 and the drum 130 are positioned lower than front portions thereof.

The water supplier 140 may be composed of a plurality of water supply valves 143 and a plurality of water supply hoses 144 and 145 to supply detergent supplied from an external water supply source HW and CW to the tub 120, the detergent dispenser 200, the steam generator 160, and the like.

In this connection, the water supplier 140 may be connected to a hot water supply source HW for supplying hot water and a cold water supply source CW for supplying cold water through a hot water hose 141 and a cold water hose 142, respectively. The water introduced through the hot water hose 141 and the cold water hose 142 may be supplied to the detergent dispenser 200, the steam generator 160, and the like through appropriate control of the water supply valve 143.

Such water supplier 140 may include a dispenser water supply hose 144 for guiding water to the detergent dispenser 200, and a steam water supply hose 145 for guiding water to the steam generator 160.

The detergent dispenser 200 may temporarily store an additive such as detergent for preliminary or main laundry washing, fabric softener, bleach, and the like, and may mix the wash water supplied as the water supplier 140 supplies the water, and the additive with each other to form the mixture and supply the mixture to the tub 120.

In one example, the detergent dispenser 200 may have a plurality of accommodation spaces defined therein compartmentalized such that the accommodated additives may be separately accommodated without mixing with each other, and water may be independently supplied to each accommodation space.

Such detergent dispenser 200 may have a dispenser housing 230 formed in a shape to be recessed into the cabinet 110, a dispenser tray 220 that is constructed to be extended from the dispenser housing 230 and stores therein the additives such as the detergent for the laundry washing, the fabric softener, the bleach, and the like, and a dispenser cover 210 disposed on the top of the dispenser housing 230 to supply the wash water to the dispenser tray 220.

In this connection, the dispenser housing 230 is in communication with the tub 120 through a water supply bellows 233. Therefore, after passing through the detergent dispenser 200 and being mixed with the additive, the water supplied by the water supplier 140 may flow into the tub 120 along the water supply bellows 233 connected to the dispenser housing 230. The detergent dispenser 200 will be described in detail after describing the component of the laundry treating apparatus.

The steam generator 160 is an apparatus for generating steam by heating the water supplied from the water supplier 140. The steam generator 160 may supply the generated steam from the front of the drum 130 to perform sterilization, wrinkle removal, and the like of the laundry inside the drum 130.

The drainage 170 is disposed underneath the tub 120 to drain the wash water that has completed the laundry washing in the tub 120. The drainage 170 may include a drain bellows 171 connected to a bottom surface of the tub 120, a drain pump 172 for pumping the wash water drained through the drain bellows 171, a drain hose 173 for draining the wash water flowed by the drain pump 172, and a circulation hose 174 that circulates the wash water flowed by the drain pump 172 to the tub.

In this connection, the drain hose 173 may be extended by forming a trap on a portion of the drain hose 173 disposed outside the laundry treating apparatus 100. At least two circulation hoses 174 may be disposed, and may be connected to circulation nozzles (not shown) formed on both sides of a gasket 190.

Therefore, when the drain pump 172 is operated, the wash water of the tub 120 may be drained through the drain hose 173, or the wash water of the tub 120 may be supplied to the tub 120 again through the circulation nozzle. To this end, the drain pump 172 may have a separate three-way valve (not shown) that sets a flow path such that the water flowed by the drain pump 172 is selectively flowed to the drain hose 173 or the circulation hose 174.

In this connection, in the present embodiment, the drain pump 172 has been described to perform both the function of the drain pump and the function of the circulation pump. Alternatively, a pump for drainage and a pump for circulation may be disposed separately.

The dryer 180 heats and circulates the air inside the tub 120, and guides flow of the air such that the air is guided back into the tub 120. The dryer 180 may include a suction duct 181 for sucking the air in the tub 120 and a supply duct 182 for guiding the flowing air to the tub 120.

In one example, a blowing fan 183 for generating a pressure for flowing the air is disposed between the suction duct 181 and the supply duct 182. The suction duct 181 connects a rear outer circumferential surface of the tub 120 and the blowing fan 183 to each other, and the supply duct 182 connects the blowing fan 183 and the gasket 190 to each other. In addition, a heater (not shown) for heating the air flowing through the supply duct 182 may be further disposed inside the supply duct 182.

In one example, the gasket 190 is disposed between the cabinet 110 and the tub 120. The gasket 190 prevents the water stored in the tub 120 from leaking to a space between the tub 120 and the cabinet 110.

In addition, one side of the gasket 190 is fastened to the laundry inlet 112 of the front surface cabinet 111, and the other side thereof is fastened to the open front surface of the tub 120. Such gasket 190 may be formed in a shape of a bellows that buffers the vibration by being elastically folded based on the vibration of the tub 120.

Hereinafter, the detergent dispenser according to an embodiment of the present disclosure will be described in detail with reference to the accompanying drawings.

Figure 3:
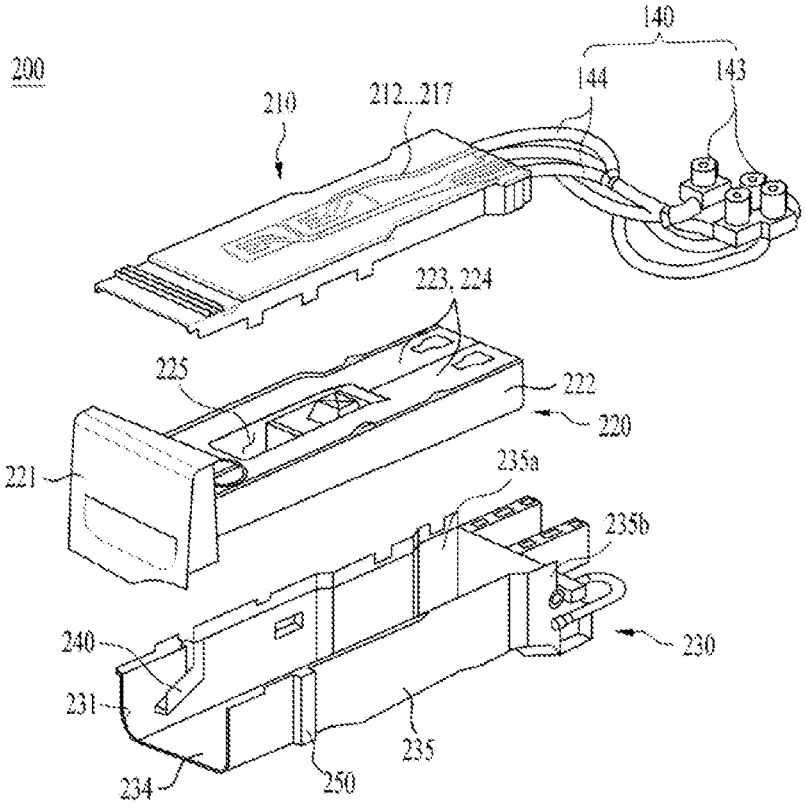
FIG. 3 is an exploded perspective view showing a detergent dispenser of a laundry treating apparatus according to an embodiment of the present disclosure.

FIG. 3 is an exploded perspective view showing a detergent dispenser of a laundry treating apparatus according to an embodiment of the present disclosure.

The detergent dispenser 200 serves to automatically supply the additive such as the detergent, the fabric softener, the bleach, and the like (hereinafter, referred to as the 'additive') into the tub 120 during a laundry washing process. The additive may refer to a substance that may enhance the laundry washing effect, and may include a powder or liquid fiber detergent, a liquid fabric softener, and the like.

The detergent dispenser 200 may include the dispenser housing 230 formed in the shape to be recessed into the cabinet 110, the dispenser tray 220 that is constructed to be extended from the dispenser housing 230 and stores therein the additive, and the dispenser cover 210 disposed on the top of the dispenser housing 230 to supply the wash water to the dispenser tray 220.

The detergent dispenser 200 may include the dispenser tray 220 in which the detergent is stored, the dispenser housing 230 that is located inside the cabinet 110, defines an entrance 231 through which the dispenser tray 220 is retracted, and at the same time, defines a path through which the detergent and the wash water flow, and the dispenser cover 210 that is located on top of the dispenser housing 230 and supplies the water to the dispenser tray 220.

The dispenser cover 210 may be supplied with the water from the outside, and may supply the supplied water into the dispenser tray 220 or the dispenser housing 230 again. The additive used in the washing process and the like may be stored inside the dispenser tray 220. The dispenser tray 220 may be accommodated and seated in the dispenser housing 230, and the dispenser housing 230 may receive the water discharged from the dispenser cover 210 or at least a portion of the detergent stored in the dispenser tray 220 and supply the received water or the detergent to the tub 120 or the like.

The dispenser tray 220 may store the detergent therein, and may be retracted into or extended from the cabinet 110 through the entrance 231 along a front and rear direction. The dispenser tray 220 may include a front handle 221, a storage frame 222, and detergent reservoirs 223 and 224 seated on the storage frame 222.

In the present disclosure, definition of forward and rearward directions may be achieved based on a position of the laundry inlet 112 in the cabinet 110. For example, a direction from the interior of the cabinet 110 toward the laundry inlet 112 may correspond to a forward direction, and a direction opposite thereto may correspond to a rearward direction.

In other words, a direction from the interior of the cabinet 110 to the exterior of the cabinet 110 through the laundry inlet 112 may be defined as the forward direction, and a direction from the laundry inlet 112 to the interior of the cabinet 110 may be defined as the rearward direction.

That is, in the present disclosure, even when the door 113 and the laundry inlet 112 are formed on and defined in different surfaces in the cabinet 110, the forward direction and the rearward direction may be defined based on the laundry inlet 112.

The dispenser cover 210 and the dispenser housing 230 may be installed at the rear of the laundry inlet 112 inside the cabinet 110, and the dispenser tray 220 may be retracted into or extended from the cabinet 110. Conversely, when the user pushes the handle 221 rearward, the dispenser tray 220 may be slid to be inserted into the cabinet 110.

That is, in the state in which the dispenser tray 220 is retracted into the cabinet 110, when the user grips and pulls or pushes the handle 221 disposed on a front surface of the dispenser tray 220 and exposed to the outside of the cabinet 110, the dispenser tray 220 may be retracted into or extended from the cabinet 110.

In one embodiment of the present disclosure, the dispenser tray 220 may be extended as much as a set extension distance determined by design by a stopper or the like. However, such limitation of the extension distance is optional, and the user is able to extend the dispenser tray 220 as much as the set extension distance or completely extend the dispenser tray 220 as needed.

In one embodiment of the present disclosure, the dispenser tray 220 may include the storage frame 222 and the detergent reservoirs 223 and 224. The storage frame 222 may be retracted into and extended from the cabinet 110 in the state in which the detergent reservoirs 223 and 224 are installed therein. The storage frame 222 may have a length extending along the front and rear direction, and may have an open top surface.

There may be various movement schemes for the storage frame 222 to be retracted into or extended from the dispenser housing 230 through the entrance 231. For example, the dispenser housing 230 may have a sliding rail (not shown) on which the storage frame 222 slides, and the storage frame 222 may be retracted and extended by being slid by the user while being supported by the sliding rail.

In addition, the handle 221 disposed on the front surface of the storage frame 222 is constructed such that a cross-section viewed from the front is larger than that of the storage frame 222 to shield the entrance 231 and prevent the storage frame 222 from being exposed to the outside.

The detergent reservoirs 223 and 224 may be formed with storage spaces in which detergents are stored. The detergent reservoirs 223 and 224 may be installed to be detachable from the storage frame 222, and the user may remove and wash the detergent reservoirs 223 and 224 as needed.

The detergent reservoirs 223 and 224 may be installed on the storage frame 222 through the open top surface of the storage frame 222, and each of the detergent reservoirs 223 and 224 may include a plurality of reservoirs and may have various shapes depending on a type of the detergent and a supply period of the detergent.

In one example, in the case of the detergent dispenser 200 as described above, the liquid or powder detergents injected into the dispenser tray 220 may flow along an inner surface of the dispenser housing 230 by the water supplied from the dispenser cover 210 and may be guided to the tub 120 through a discharge hole 232 defined in a bottom surface of the dispenser housing 230.

In such process, detergent mixed with the water or detergent not mixed with the water may remain on the inner surface of the dispenser housing 230 and adhere to the inner surface of the dispenser housing 230. The detergent adhered to the inner surface of the dispenser housing 230 as such is not visually good when the user removes the dispenser tray 220, and odor may occur from the remaining detergent. Accordingly, a flow path structure that may effectively discharge the detergent remaining on the inner surface of the dispenser housing 230 through the discharge hole 232 is required.

Hereinafter, with reference to the accompanying drawings, the dispenser cover 210 and the dispenser housing 230 that may minimize the detergent remaining in the detergent dispenser 200 will be described in detail.

Figure 4:
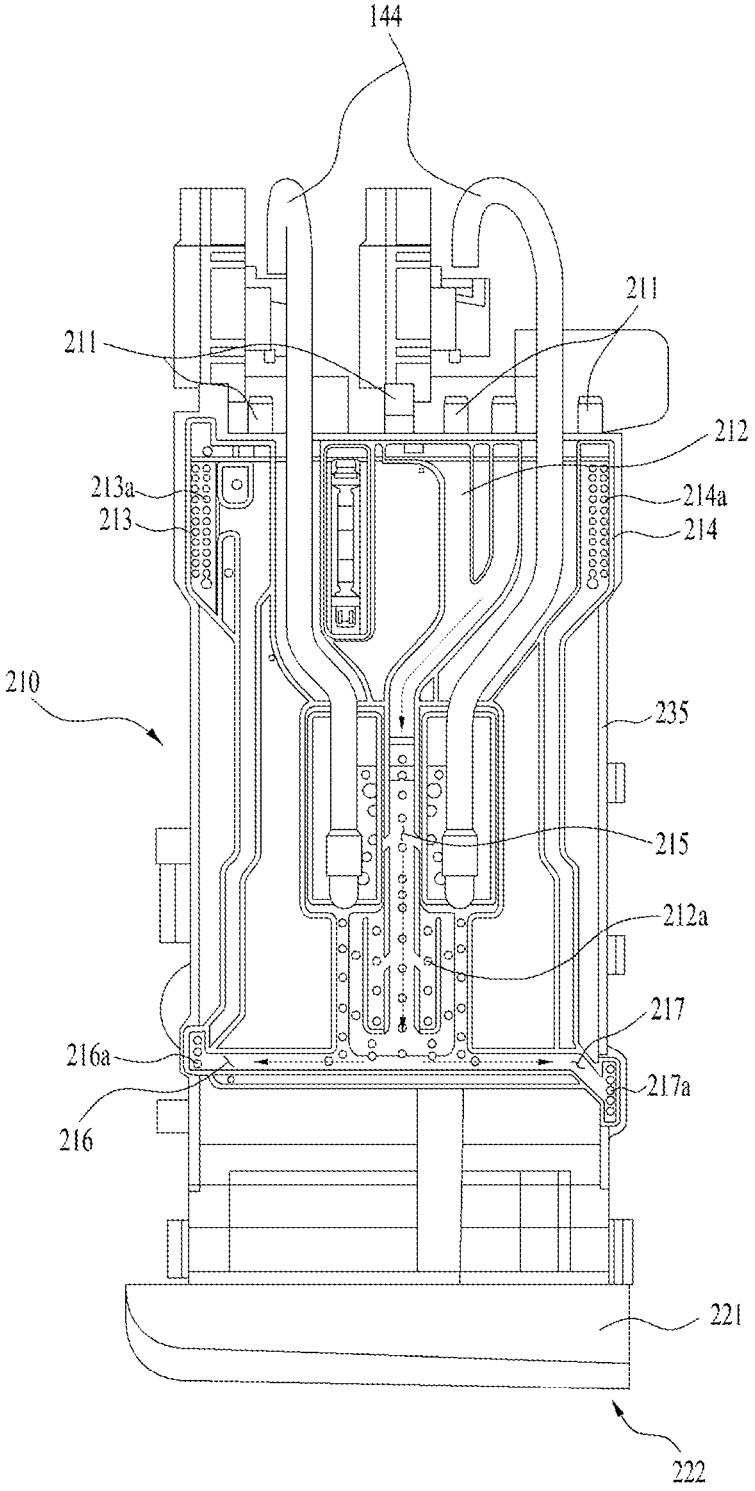
FIG. 4 is a plan view showing a flow path of a dispenser cover according to an embodiment of the present disclosure.
Figure 5:
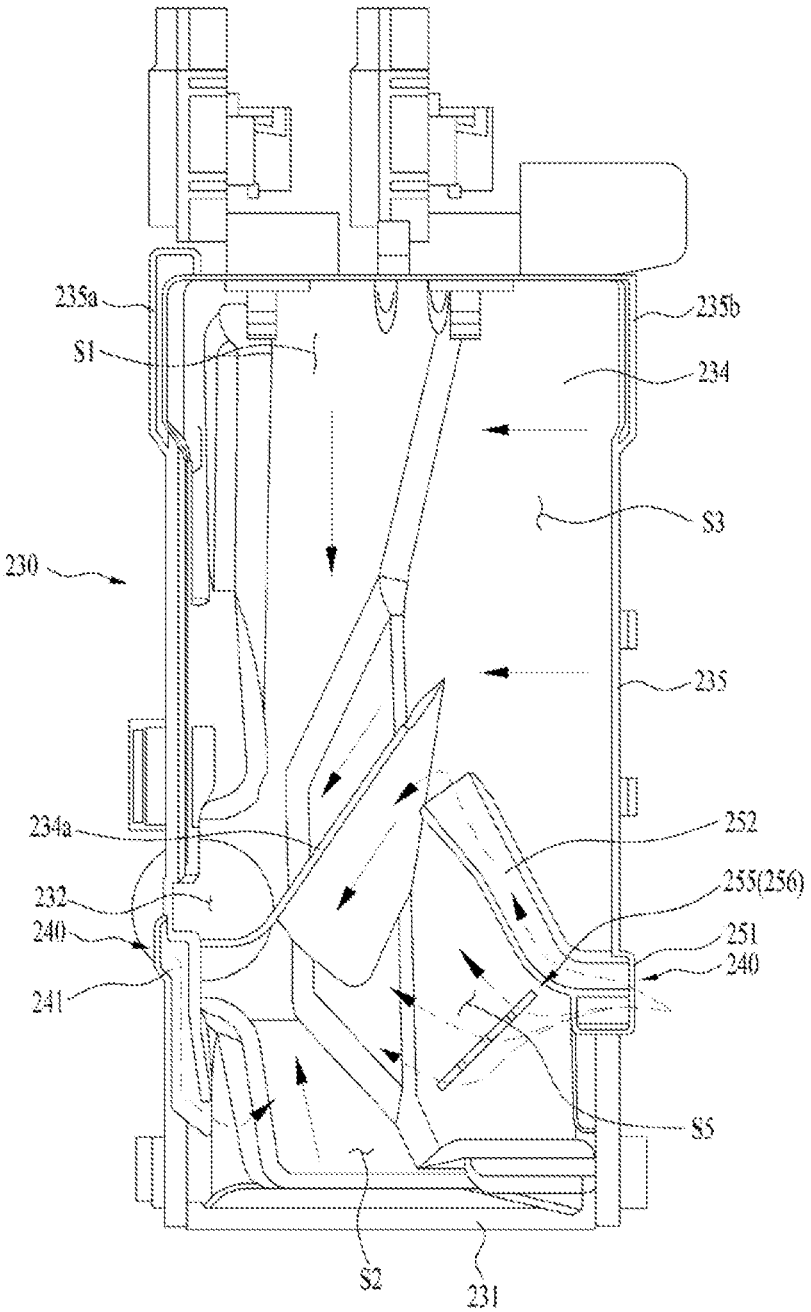
FIG. 5 is a plan view showing an inner surface structure of a dispenser housing according to an embodiment of the present disclosure.

FIG. 4 is a plan view showing a flow path of a dispenser cover according to an embodiment of the present disclosure, and FIG. 5 is a plan view showing an inner surface structure of a dispenser housing according to an embodiment of the present disclosure.

As shown in FIG. 4, a plurality of flow paths 212, 213, 214, 215, 216, and 217 for supplying the water directly to the dispenser tray 220 retracted into the dispenser housing 230 or the dispenser housing 230 may be defined in the dispenser cover 210 of the present disclosure.

The dispenser cover 210 may be formed in a rectangular enclosure shape that has therein a space inside which the wash water may flow and is for covering the dispenser housing 230.

In this connection, a plurality of water supply hose connection portions 211 to which a plurality of dispenser water supply hoses 144 are respectively connected may be formed on a rear surface of the dispenser cover 210, a plurality of water supply holes 212*a*, 213*a*, 214*a*, 216*a*, and 217*a* for supplying the wash water supplied from the water supply hose connection portions 211 to the dispenser tray 220 and the dispenser housing 230 are defined in the bottom surface of the dispenser cover 210, and the plurality of flow paths 212, 213, 214, 215, 216, and 217 for selectively guiding the wash water supplied from the water supply hose connection portions 211 to the water supply holes 212*a*, 213*a*, 214*a*, 216*a*, and 217*a* may be defined inside the dispenser cover 210.

In this connection, the plurality of water supply holes 212*a*, 213*a*, 214*a*, 216*a*, and 217*a* may include a tray water supply hole 212*a* defined at a center of the dispenser cover 210 to supply the wash water to the dispenser tray 220, first and second rear water supply holes 213*a* and 214*a* defined on both sides of a rear portion of the dispenser cover 210 to supply the wash water to a rear portion of the dispenser housing 230, and first and second front water supply holes 216*a* and 217*a* defined on both sides of a front portion of the dispenser cover 210 to supply the wash water to the both sides of the front portion of the dispenser housing 230. In one example, each of the water supply holes 212*a*, 213*a*, 214*a*, 216*a*, and 217*a* may be defined by a plurality of through-holes to supply the wash water to the rear and front portions of the dispenser tray 220 and the dispenser housing 230.

In one example, the plurality of flow paths 212, 213, 214, 215, 216, and 217 may include a tray water supply flow path 212 for guiding the wash water supplied through the water supply hose connection portions 211 to the tray water supply hole 212*a*, a first rear flow path 213 and a second rear flow path 214 for respectively guiding the wash water to the first rear water supply hole 213*a* and the second rear water supply hole 214*a*, and a first front branch flow path 216 and a second front branch flow path 217 for respectively guiding the wash water to the first front water supply hole 216*a* and the second front water supply hole 217*a*.

In this connection, the first front branch flow path 216 and the second front branch flow path 217 may be constructed to respectively branched toward the first front water supply hole 216*a* and the second front water supply hole 217*a* located on both sides of the dispenser cover 210 from a front end of a front supply flow path 215 that is defined to penetrate the center of the dispenser cover 210.

The dispenser housing 230 may be formed in a shape of an enclosure with open top and front surfaces as shown in FIG. 5. The dispenser cover 210 may be seated and fixed in the dispenser housing 230 through the open top surface of the dispenser housing 230, and the entrance 231 may be defined in the open front surface of the dispenser housing 230 such that the dispenser tray 220 may be retracted and extended therethrough.

In one example, the discharge hole 232 for the wash water supplied from the dispenser cover 210 and the detergent of the dispenser tray 220 to be mixed with each other and supplied to the tub 120 may be defined on one side of the bottom surface of the dispenser housing 230. The discharge hole 232 may be connected to the tub 120 by the separate water supply bellows 233.

First and second rear flow paths 235*a* and 235*b* and first and second front flow paths 240 and 250 for respectively guiding the wash water discharged from the first and second rear water supply holes 213*a* and 214*a* and the first and second front water supply holes 216*a* and 217*a* to the bottom surface of the dispenser housing 230 may be defined in front and rear portions of an inner wall of the dispenser housing 230.

In this connection, the first and second rear flow paths 235*a* and 235*b* and the first and second front flow paths 240 and 250 are defined in an outwardly concave shape in the inner wall of the dispenser housing 230 to guide the wash water discharged from the first and second rear water supply holes 213*a* and 214*a* and the first and second front water supply holes 216*a* and 217*a* so as not to be scattered.

In one example, the discharge hole 232 may be defined on one side in a longitudinal direction of the dispenser housing 230, and the dispenser housing 230 may have a bottom surface 234 on which a plurality of inclined surfaces S1, S2, and S3 are formed in a direction in which the discharge hole 232 is defined.

The plurality of inclined surfaces S1, S2, and S3 may include a first inclined surface S1 inclined at the rear portion of the dispenser housing 230 downward toward the discharge hole 232, a second inclined surface S2 inclined at the front portion of the dispenser housing 230 downward toward the discharge hole 232, and a third inclined surface S3 inclined on a side facing the discharge hole 232 downward toward the discharge hole.

Such first, second, and third inclined surfaces S1, S2, and S3 may allow the bottom surface of the dispenser housing 230 to be inclined downward toward the discharge hole to allow the wash water and the detergent mixed with the wash water to be easily discharged into the discharge hole 232 from the dispenser tray 220.

In one example, the first rear flow path 235*a* guides the wash water discharged through the first rear water supply hole 213*a* of the first rear flow path 213 of the dispenser cover 210 to a rear edge on one side of the dispenser housing 230. The wash water guided by the first rear flow path 235*a* may be guided to the discharge hole 232 by the first inclined surface S1 from one side of a rear portion of the bottom surface 234 of the dispenser housing 230.

Therefore, the wash water guided through the first rear flow path 235*a* may wash foreign substances such as detergent residues or the like remaining on the rear edge on one side of the bottom surface 234 while flowing down along the first inclined surface S1 from the rear edge on one side of the bottom surface 234 to allow the foreign substances to flow into the discharge hole 232.

In addition, the second rear flow path 235*b* guides the wash water discharged through the second rear water supply hole 214*a* of the second rear flow path 214 of the dispenser cover 210 to a rear edge on the other side of the dispenser housing 230. The wash water guided by the second rear flow path 235*b* may be guided to the discharge hole 232 by the third inclined surface S3 from the other side of the rear portion of the bottom surface 234 of the dispenser housing 230.

Therefore, the wash water guided through the second rear flow path 235*b* may wash foreign substances such as detergent residues or the like remaining on the rear edge on the other side of the bottom surface 234 while flowing down along the third inclined surface S3 from the rear edge on the other side of the bottom surface 234 to allow the foreign substances to flow into the discharge hole 232.

Hereinafter, the first front flow path and the second front flow path will be described with reference to the accompanying drawings.

First, the first front flow path will be described in detail with reference to FIGS. 6 to 9.

Figure 6:
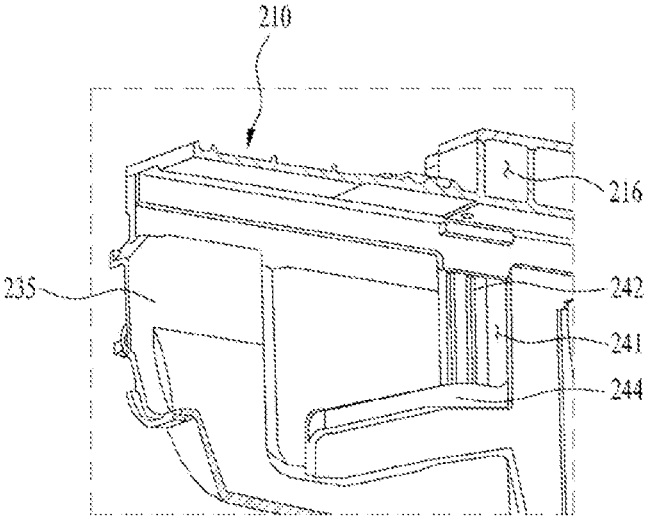
FIGS. 6 to 7 are perspective views showing a first flow path of a dispenser cabinet according to an embodiment of the present disclosure.
Figure 7:
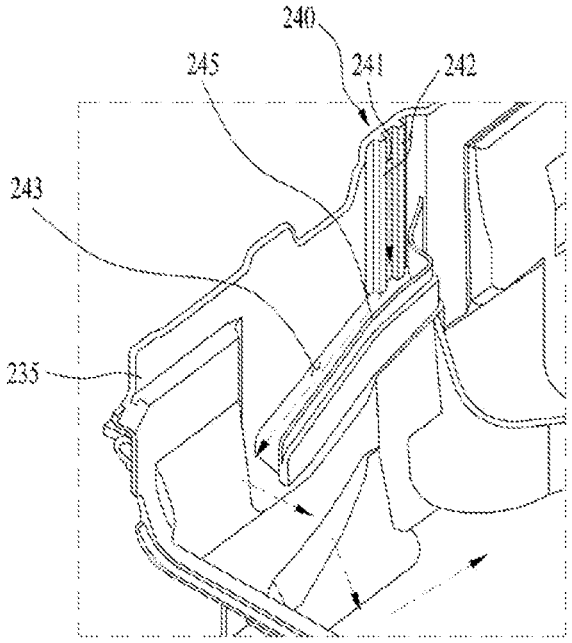
Figure 8:
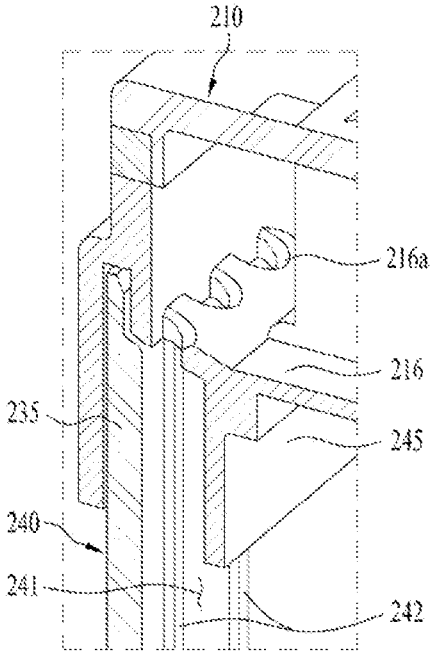
FIG. 8 is a partial cross-sectional view showing a vertical flow path of a first front flow path shown in FIG. 6.
Figure 9:
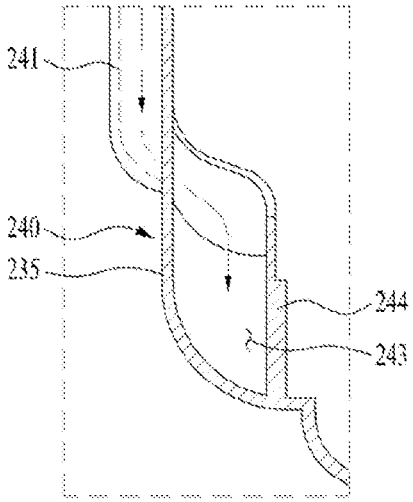
FIG. 9 is a partial cross-sectional view showing an inclined flow path of a first front flow path shown in FIG. 6.

FIGS. 6 to 7 are perspective views showing a first flow path of a dispenser cabinet according to an embodiment of the present disclosure, FIG. 8 is a partial cross-sectional view showing a vertical flow path of a first front flow path shown in FIG. 6, and FIG. 9 is a partial cross-sectional view showing an inclined flow path of a first front flow path shown in FIG. 6.

As shown in FIGS. 6 to 7, the first front flow path 240 may include a first vertical flow path 241 defined in a form of being recessed with respect to a side wall 235 on one side of an inner front portion of the dispenser housing 230, and a first inclined flow path 243 extending from the first vertical flow path 241 and protruding from the side wall 235 inwardly of the dispenser housing 230.

The first vertical flow path 241 may guide the wash water discharged through the first front water supply hole 216*a* of the dispenser cover 210 to flow downward along an inner surface of the side wall 235 to flow to the first inclined flow path 243.

A plurality of guide ribs 242 in a direction parallel to a formation direction of the first vertical flow path 241 may be formed on the first vertical flow path 241 such that the flowing wash water flows along an inner surface of the first vertical flow path 241. The plurality of guide ribs 242 may prevent the wash water flowing through the first vertical flow path 241 from scattering into the dispenser housing 230 by increasing a contact area with the wash water.

In one example, an extension rib 245 in a form of covering a top of the first vertical flow path 241 may be further formed below the first front water supply hole 216*a*. The extension rib 245 may block the scattering of the wash water from the first front water supply hole 216*a* into the dispenser housing 230 when the wash water is sprayed from the first front water supply hole 216*a* to the first vertical flow path 241.

The first inclined flow path 243 is defined to be in communication with a lower portion of the first vertical flow path 241 and is defined to protrude from the inner surface of the side wall 235 inwardly of the dispenser housing 230. Therefore, wash water flowing through the first vertical flow path 241 defined outwardly of the side wall 235 may flow down toward the first inclined flow path 243 in a form of penetrating the side wall 235.

In this connection, the first inclined flow path 243 may be formed to be inclined from the first vertical flow path 241 toward one side of the inner front portion of the dispenser housing 230. That is, the first inclined flow path 243 guides the wash water flowing through the first vertical flow path 241 to one side of the inner front portion of the dispenser housing 230.

In this connection, along a longitudinal direction of the first inclined flow path 243, a guide partition wall 244 that partitions the first inclined flow path 243 and the dispenser housing 230 may be formed. The guide partition wall 244 guides the wash water such that the wash water flowing along the first inclined flow path 243 may flow to one side of the front portion of the dispenser housing along the first inclined flow path 243.

In one example, the wash water supplied from the first front water supply hole 216*a* to the first front flow path 240 flows to one side of the front portion of the bottom surface 234 of the dispenser housing while flowing along the first vertical flow path 241 and the first inclined flow path 243. Therefore, detergent residues and foreign substances remaining on one side of the front portion of the bottom surface of the dispenser housing may flow into the discharge hole 232 by the wash water.

Hereinafter, the second front flow path will be described in detail with reference to FIGS. 10 to 11.

Figure 10:
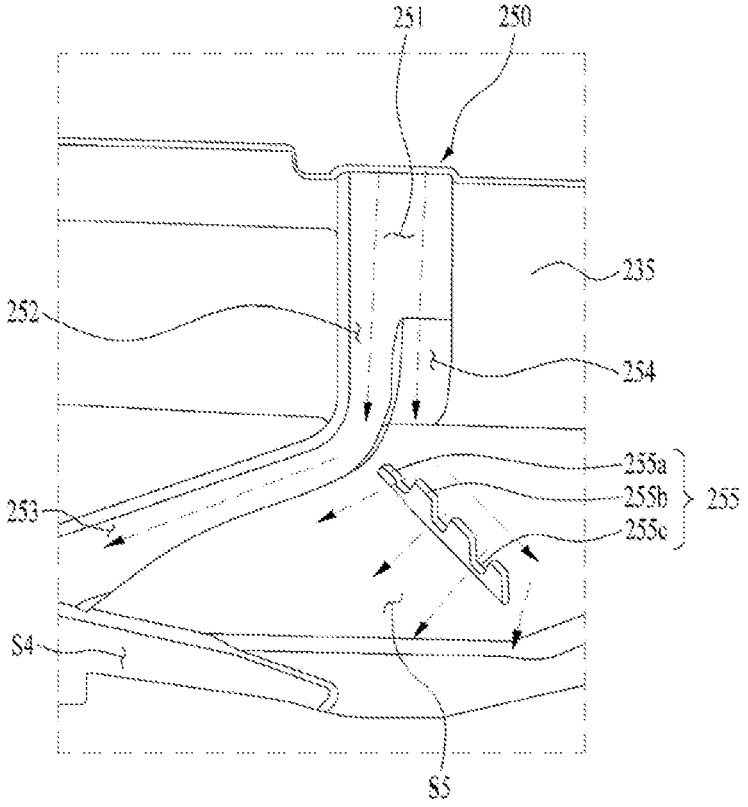
FIG. 10 is a perspective view showing a second front flow path of a dispenser cabinet according to an embodiment of the present disclosure.
Figure 11:
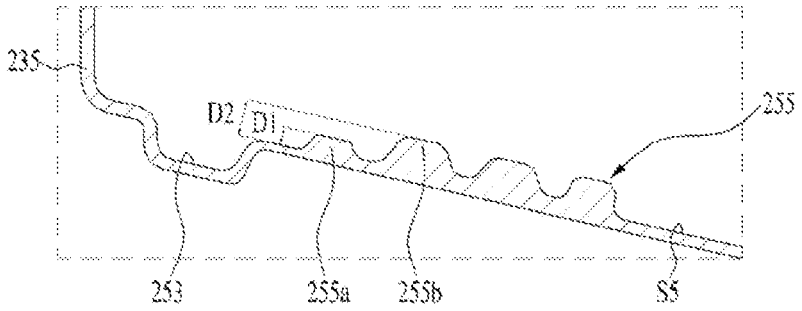
FIG. 11 is a partial cross-sectional view showing a dispersion rib of a second front flow path shown in FIG. 10.

FIG. 10 is a perspective view showing a second front flow path of a dispenser cabinet according to an embodiment of the present disclosure, and FIG. 11 is a partial cross-sectional view showing a dispersion rib of a second front flow path shown in FIG. 10.

As shown in FIGS. 10 to 11, the second front flow path 250 may include a second vertical flow path 251 defined on the other side of the inner front portion of the dispenser housing and recessed with respect to the side wall 235 on the other side of the inner front portion of the dispenser housing 230, and a second inclined flow path 252 and a third inclined flow path 254 extending from the second vertical flow path 251 and branching from the side wall 235 to the bottom surface 234 of the dispenser housing 230.

The second vertical flow path 251 guides the wash water discharged through the second front water supply hole 217*a* of the dispenser cover 210 to flow downward along the inner surface of the side wall 235 to flow to the second inclined flow path 252 and the third inclined flow path 254.

In this connection, like the first vertical flow path 241 described above, the second vertical flow path 251 may further include a guide rib (not shown) for guiding the wash water flowing through the second vertical flow path 251, and an extension rib (not shown) for preventing the wash water sprayed from the second front water supply hole 217*a* from scattering.

In one example, the second inclined flow path 252 and the third inclined flow path 254 may be constructed to guide the wash water flowing along the second vertical flow path 251 from a lower end of the second vertical flow path 251 in different directions.

Specifically, as shown in FIG. 5, the second inclined flow path 252 may be defined to guide the wash water from a lower portion of the second vertical flow path 251 to the rear portion of the dispenser housing 230, and the third inclined flow path 254 may be defined to guide the wash water from the lower portion of the second vertical flow path 251 to the front portion of the dispenser housing 230.

The second inclined flow path 252 may be distinguished by the definition of the third inclined flow path 254. That is, the second vertical flow path 251 may be defined to be recessed inwardly of the side wall with a predetermined width, and the third inclined flow path 254 may be defined by protruding at a location underneath the second vertical flow path 251 with a different inclination with respect to the second vertical flow path 251. The second inclined flow path 252 may correspond to a portion of the second vertical flow path 251 in which the third inclined flow path 254 is not defined.

The second inclined flow path 252 extends from one side of the lower portion of the second vertical flow path 251 to the bottom surface 234 of the dispenser housing 230, and the bottom surface 234 has a guide groove 253 defined to be inclined rearwardly of the bottom surface 234 along the third inclined surface S3 from the lower portion of the second vertical flow path 251.

The guide groove 253 may guide the wash water flowing along the second inclined flow path 252 to the center of the bottom surface 234 to flow the detergent residue and the foreign substance remaining at the center of the bottom surface 234 to the discharge hole 232.

A fourth inclined surface S4 for guiding the wash water flowing along the guide groove 253 toward the discharge hole 232 may be formed at a distal end of the guide groove 253. The fourth inclined surface S4 may be formed at a downstream of the third inclined surface S3 to be inclined toward the discharge hole 232. Accordingly, a portion of the wash water flowing along the third inclined surface S3 and the wash water flowing along the guide groove 253 may flow along the fourth inclined surface S4 to the discharge hole 232.

Additionally, an inclined partition wall 234*a* extending inwardly of the discharge hole 232 from the fourth inclined surface S4 may be further disposed at an upper portion of the fourth inclined surface S4. The inclined partition wall 234*a* may guide the portion of the wash water flowing along the third inclined surface S3 and the wash water flowing along the second inclined flow path 252 toward the discharge hole 232.

As shown in FIGS. 5 and 10, the third inclined flow path 254 may protrude from the lower portion of the second vertical flow path 251 to guide the portion of the wash water flowing through the second vertical flow path 251 toward the front portion of the bottom surface. The third inclined flow path 254 may be defined as a curved surface in a concave form that connects the second vertical flow path 251 and the bottom surface 234 to each other.

A fifth inclined surface S5 inclined toward the discharge hole 232 from the other side of the front portion of the dispenser housing 230 may be formed underneath the third inclined flow path 254. The wash water flowing through the third inclined flow path 254 flows to the other side of the front portion of the dispenser housing 230 and flow to the discharge hole 232 by the fifth inclined surface S5.

Therefore, the detergent residue and the foreign substance remaining on the other side of the front portion of the bottom surface 234 of the dispenser housing 230 may be moved to the discharge hole 232 by the wash water flowing from the third inclined flow path 254 to the fifth inclined surface S5.

In this connection, as shown in FIGS. 10 and 11, a dispersion rib 255 for diffusing the wash water flowing along the fifth inclined surface S5 may be formed on the fifth inclined surface S5. The wash water flowing from the third inclined flow path 254 to the fifth inclined surface S5 may flow to the discharge hole 232 by forming the shortest distance in the third inclined flow path 254 by an inclination of the fifth inclined surface S5. In this case, the discharge of the detergent residue and the foreign substance by the flow of the wash water on the other side of the front portion of the bottom surface 234 may not proceed smoothly.

Therefore, the fifth inclined surface S5 needs to diffuse the wash water flowing along the fifth inclined surface S5 from the third inclined flow path 254 before flowing to the discharge hole 232 to move the detergent residues or the foreign substance on the other side in the front portion of the bottom surface 234.

Thus, the dispersion rib 255 may be formed in a direction orthogonal to an inclined direction of the fifth inclined surface on the fifth inclined surface S5. The dispersion rib 255 may be formed in a direction orthogonal to a flow direction of the wash water flowing along the fifth inclined surface S5 to form a flow resistance of the wash water flowing through the fifth inclined surface S5, thereby allowing the wash water to be diffused on the fifth inclined surface S5.

In one example, the dispersion rib 255 may be formed in a shape of a plurality of ribs having a predetermined height protruding from the fifth inclined surface S5 as shown in FIG. 11. Preferably, at least two or more ribs having different heights may be compositely formed.

Specifically, the dispersion rib 255 may include a first dispersion rib 255*a* having a predetermined height D1, and a second dispersion rib 255*b* having a height D2 equal to or greater than the height of the first dispersion rib 255*a*. In addition, a dispersion groove 255*c* may be defined between the first dispersion rib 255*a* and the second dispersion rib 255*b* such that a portion of the wash water passes between the first dispersion rib 255*a* and the second dispersion rib 255*b*.

In this connection, the first dispersion rib 255*a* having the relatively small height may be formed at an upper portion of the fifth inclined surface S5, and a plurality of second dispersion ribs 255*b* may be sequentially formed on a longitudinal extension line of the first dispersion ribs 255*a* downward of the fifth inclined surface S5.

In one example, the plurality of second dispersion ribs 255*b* have been described as being able to be formed on the longitudinal extension line of the first dispersion rib 255*a*. However, depending on a flow rate and a flow speed of the wash water flowing down along the fifth inclined surface S5, the plurality of second dispersion ribs 255*b* may be formed at different locations to be spaced apart from each other on the fifth inclined surface S5 rather than on the extension line of the first dispersion rib 255*a*.

The first front flow path 240 and the second front flow path 250 as described above supply the wash water to one side and the other side of the front portion of the bottom surface 234 of the dispenser housing 230, thereby allowing the detergent residue and the foreign substance remaining on one side and the other side of the front portion of the bottom surface 234 to be moved to the discharge hole 232 and removed along with the supply of the wash water.

As described above, the preferred embodiment of the present disclosure has been described in detail, but a person with ordinary skill in the technical field to which the present disclosure belongs will be able to implement the present disclosure in various ways without departing from the spirit and scope of the present disclosure defined in the appended claims. Therefore, future changes in embodiments of the present disclosure will not be able to deviate from the description of the present disclosure.

What is claimed is:

1. A laundry treating apparatus comprising:

a cabinet having an entrance defined at a front surface thereof;

a tub disposed in the cabinet;

a drum that is rotatably disposed in the tub, the drum having an opening defined at a front surface thereof and configured to receive laundry;

a rotation shaft that extends in a front-rear direction and is coupled to a rear surface of the drum; and a detergent dispenser configured to be inserted into and withdrawn from the cabinet through the entrance of the cabinet, the detergent dispenser being configured to store detergent, wherein the detergent dispenser comprises:

a dispenser tray configured to be inserted into and withdrawn from the cabinet through the entrance of the cabinet, the dispenser tray being configured to store an auxiliary agent and to discharge the auxiliary agent together with wash water, a dispenser housing that is disposed inside the cabinet and defines an accommodating space that accommodates the dispenser tray, the dispenser housing having a discharge hole that is defined at a bottom surface of the dispenser housing and in communication with the tub, and a dispenser cover disposed on the dispenser housing and configured to supply the wash water to the dispenser tray or the dispenser housing, the dispenser cover defining a front supply flow path configured to supply the wash water to a front portion of the dispenser housing, wherein the dispenser housing defines a front flow path configured to diffuse the wash water supplied from the front supply flow path and to guide the wash water toward the discharge hole, the front flow path being defined at a front portion of the bottom surface of the dispenser housing, and wherein the front flow path comprises a vertical flow path defined at a side wall of the dispenser housing and recessed outward from the side wall of the dispenser housing.

2. The laundry treating apparatus of claim 1, wherein the dispenser housing comprises a plurality of guide ribs disposed at the vertical flow path and configured to guide the wash water supplied from the front supply flow path.

3. The laundry treating apparatus of claim 1, wherein the front flow path further comprises an inclined flow path that is connected to the vertical flow path, that protrudes inward from the side wall, and that extends downward to the bottom surface along the side wall, the inclined flow path being inclined forward relative to the vertical flow path.

4. The laundry treating apparatus of claim 3, wherein the front supply flow path comprises a plurality of water supply holes configured to supply the wash water to the vertical flow path, and wherein the front supply flow path is disposed between the plurality of water supply holes and extends to the inclined flow path.

5. The laundry treating apparatus of claim 4, wherein the dispenser housing comprises an extension rib that covers at least a portion of the vertical flow path and that is located below at least one of the plurality of water supply holes.

6. The laundry treating apparatus of claim 3, wherein the dispenser housing comprises a guide partition wall that is disposed at the inclined flow path and extends parallel to the inclined flow path, the guide partition wall being configured to limit deviation of the wash water flowing through the vertical flow path.

7. The laundry treating apparatus of claim 3, wherein the vertical flow path is located rearward relative to the front portion of the dispenser housing, and wherein the inclined flow path is configured to guide the wash water toward the front portion of the dispenser housing.

8. The laundry treating apparatus of claim 3, wherein the dispenser housing comprises an inclined surface disposed at the front portion of the bottom surface and configured to guide the wash water guided through the inclined flow path toward the discharge hole.

9. The laundry treating apparatus of claim 1, wherein the front flow path further comprises a first inclined flow path configured to guide a first portion of the wash water from the vertical flow path toward the front portion of the bottom surface.

10. The laundry treating apparatus of claim 9, wherein the first inclined flow path has a concavely curved surface that is connected to a lower portion of the vertical flow path and extends to the front portion of the bottom surface.

11. The laundry treating apparatus of claim 9, wherein the dispenser housing further comprises an inclined surface disposed at the front portion of the bottom surface and configured to guide the wash water guided through the first inclined flow path toward the discharge hole.

12. The laundry treating apparatus of claim 9, wherein the front flow path further comprises a second inclined flow path configured to guide a second portion of the wash water from the vertical flow path toward a center of the bottom surface.

13. The laundry treating apparatus of claim 12, wherein the dispenser housing further defines a guide groove at the bottom surface, the guide groove being connected to the second inclined flow path and configured to guide the second portion of the wash water toward the center of the bottom surface.

14. The laundry treating apparatus of claim 13, wherein the dispenser housing comprises an inclined surface disposed at the bottom surface and configured to guide the wash water guided by the guide groove toward the discharge hole.

15. The laundry treating apparatus of claim 9, further comprising a dispersion rib that protrudes from the bottom surface of the dispenser housing and is configured to apply a flow path resistance in a direction transverse to a flow direction of the wash water guided by the first inclined flow path.

16. The laundry treating apparatus of claim 15, wherein the dispersion rib comprises a plurality of dispersion ribs having one or more predetermined heights and defines a dispersion groove between adjacent two dispersion ribs of the plurality of dispersion ribs, the dispersion groove being configured to allow the wash water to flow therethrough.

17. The laundry treating apparatus of claim 16, wherein the plurality of dispersion ribs comprise a first dispersion rib having a first predetermined height and a second dispersion rib having a second height greater than the first predetermined height, the first dispersion rib being located at an upper portion of the first inclined flow path relative to the second dispersion rib.

18. The laundry treating apparatus of claim 1, wherein the vertical flow path comprises:

a first vertical flow path defined at a first side wall of the dispenser housing and recessed outward from the first side wall of the dispenser housing; and a second vertical flow path defined at a second side wall of the dispenser housing and recessed outward from the second side wall of the dispenser housing, and wherein the front flow path further comprises:

a first inclined flow path that is connected to the first vertical flow path, that protrudes inward from the first side wall, and that extends downward to the bottom surface along the first side wall, the first inclined flow path being inclined forward relative to the first vertical flow path, a second inclined flow path configured to guide a portion of the wash water from the second vertical flow path to the front portion of the bottom surface, and a third inclined flow path that extends from the second vertical flow path and is configured to guide the wash water in a flow direction from the second side wall to the front portion of the bottom surface.

19. The laundry treating apparatus of claim 18, further comprising a plurality of dispersion ribs that protrude from the bottom surface of the dispenser housing and is configured to apply a flow path resistance in a direction transverse to the flow direction of the wash water guided by the third inclined flow path.

* * * * *